US006308472B1

(12) United States Patent
Coulton et al.

(10) Patent No.: US 6,308,472 B1
(45) Date of Patent: Oct. 30, 2001

(54) ADJUSTABLE ROOF RIDGE VENT

(75) Inventors: Michael S. Coulton, Lansdale; Kenneth L. Laubsch, Chalfont, both of PA (US)

(73) Assignee: Benjamin Obdyke, Inc., Horsham, PA (US)

( * ) Notice: Subject to any disclaimer, the term of this patent is extended or adjusted under 35 U.S.C. 154(b) by 0 days.

(21) Appl. No.: 09/480,385

(22) Filed: Jan. 10, 2000

Related U.S. Application Data

(60) Provisional application No. 60/115,327, filed on Jan. 11, 1999.

(51) Int. Cl.[7] ..... E04B 7/00

(52) U.S. Cl. ..... 52/198; 52/200; 52/199; 454/199; 428/906

(58) Field of Search ..... 52/198, 199; 454/275, 454/292, 199; 428/906

(56) References Cited

U.S. PATENT DOCUMENTS

| | | | |
|---|---|---|---|
| 1,717,728 | 6/1929 | Moore . | |
| 2,200,031 | 5/1940 | Lee . | |
| 2,214,183 | 9/1940 | Seymour . | |
| 2,704,500 | 3/1955 | Bonforte . | |
| 2,799,214 | 7/1957 | Roose . | |
| 2,868,104 | 1/1959 | Honholt et al. . | |
| 3,185,070 | 5/1965 | Smith . | |
| 3,236,170 | 2/1966 | Meyer et al. . | |
| 3,311,047 | 3/1967 | Smith et al. . | |
| 3,481,263 | 12/1969 | Belden . | |
| 3,660,955 | 5/1972 | Simon | 52/420 |
| 3,949,657 | 4/1976 | Sells | 98/42 A |
| 4,280,399 | 7/1981 | Cunning | 98/42 A |
| 4,325,290 | 4/1982 | Wolfert | 98/42 A |
| 4,554,862 | 11/1985 | Wolfert | 98/42.21 |
| 4,876,950 | 10/1989 | Rudeen | 98/42.21 |
| 4,903,445 | 2/1990 | Mankowski | 52/199 |
| 4,942,699 | 7/1990 | Spinelli | 52/57 |
| 4,957,037 | 9/1990 | Tubbesing et al. | 98/42.21 |
| 4,962,692 | 10/1990 | Shuert | 98/42.21 |
| 5,094,041 | 3/1992 | Kasner et al. | 52/57 |
| 5,122,095 | 6/1992 | Wolfert | 454/365 |
| 5,167,579 | 12/1992 | Rotter | 454/365 |
| 5,174,076 | 12/1992 | Schiedegger et al. | 52/199 |
| 5,288,269 | 2/1994 | Hansen | 454/365 |
| 5,425,672 | 6/1995 | Rotter | 454/365 |
| 5,651,734 | 7/1997 | Morris | 454/365 |
| 5,673,521 | 10/1997 | Coulton et al. | 52/199 |
| 5,902,432 | 5/1999 | Coulton et al. | 156/199 |
| 5,960,595 | 10/1999 | McCorsley, III et al. | 52/199 |

*Primary Examiner*—Carl D. Friedman
*Assistant Examiner*—Patrick J. Chavez
(74) *Attorney, Agent, or Firm*—Howson and Howson

(57) ABSTRACT

A roll-form roof ridge vent having alignment means to facilitate ease of installation. The indeterminate-length, single-sheet vent is provided with a pliable medial hinge strip, or a set of expandable live hinges, which enable the otherwise straight vent to be laterally and/or angularly repositioned from its substantially straight configuration. Thus, lateral adjustments can be made to the positioning of the vent as it is being installed so that the vent is centered throughout its length over the roof ridge. The lateral adjustments do not result in buckling of the vent or unwanted distortion.

20 Claims, 6 Drawing Sheets

20
30
38
22
44
28
26

12
12
36
40
18
"h"
10

FIG.1A
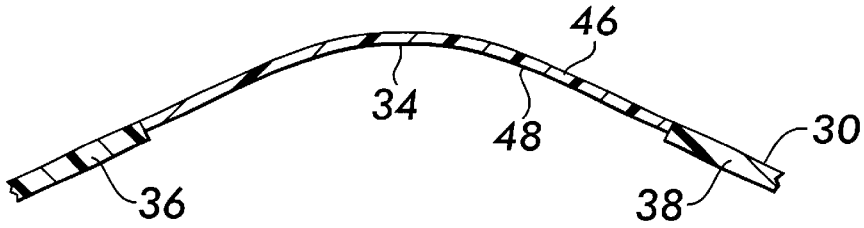
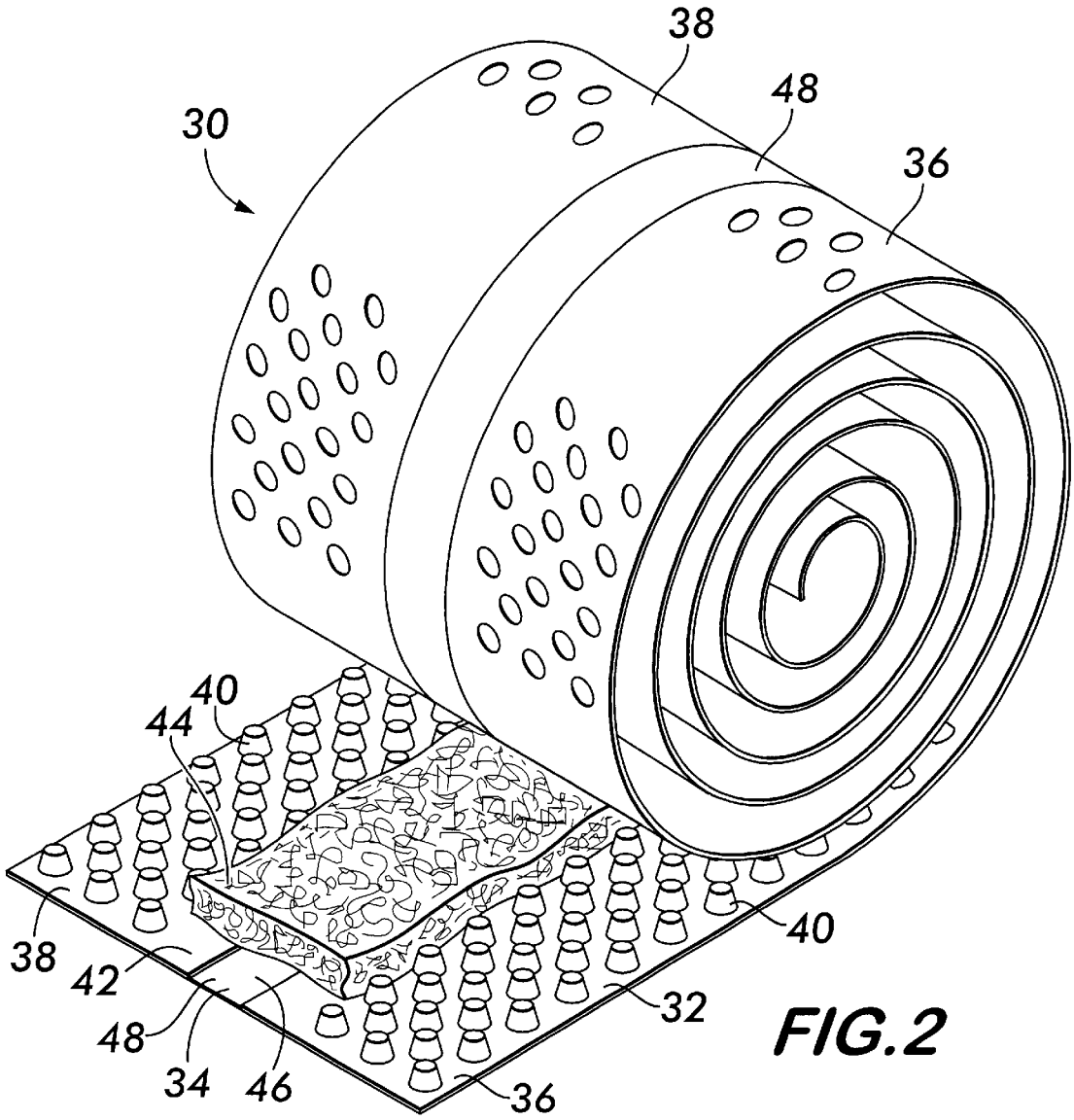
FIG.2

FIG. 6
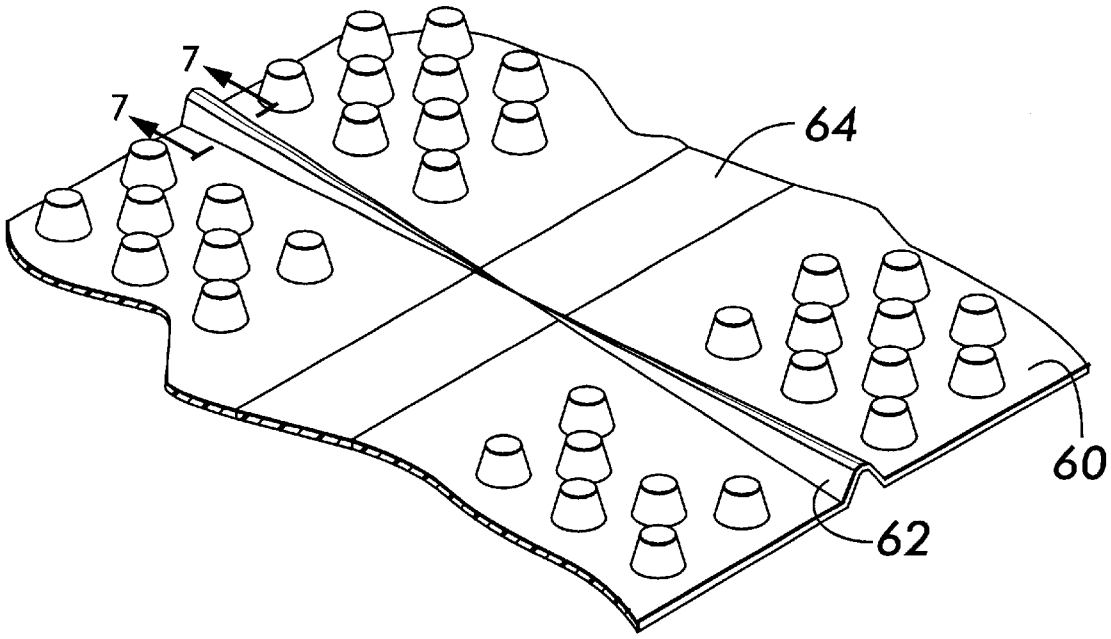
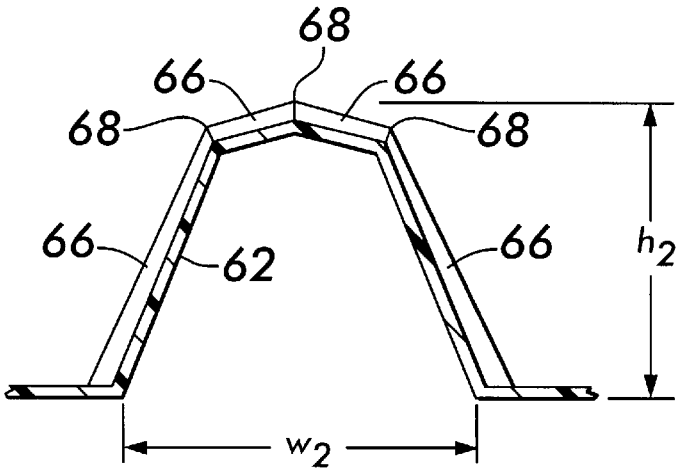
FIG. 7

FIG.8
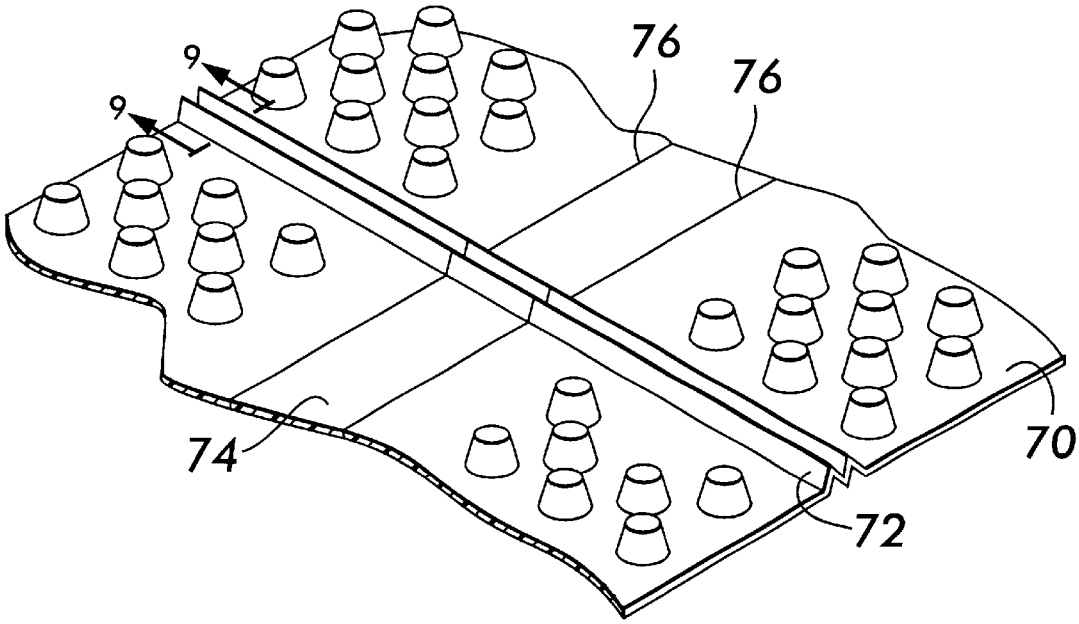
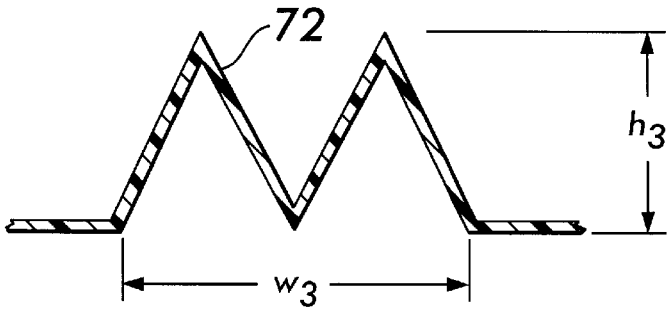
FIG.9

ADJUSTABLE ROOF RIDGE VENT

This application claims benefit of Prov. No. 60/115,327 filed Jan. 11, 1999.

FIELD OF THE INVENTION

The present invention relates to a roof ridge vent for use in building construction to enhance the circulation of air in a space between the roof and an underlying ceiling structure, and more particularly, the present invention relates to an adjustable, rollable, roof ridge vent which can be readily aligned with the roof ridge during installation to ensure that the vent is properly centered along its length over the roof ridge.

BACKGROUND OF THE INVENTION

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

An example of a roof ridge vent is provided by U.S. Pat. No. 5,673,521 issued to Coulton et al. and owned by the assignee of the present application. The '521 patent discloses a roof ridge vent comprising a continuous, indeterminate-length, single sheet, roll-formed web of thermoformable material which is capable of being rolled lengthwise in a spiral roll during manufacture and unrolled lengthwise during installation on the roof ridge. The vent is sequentially thermoformed with a plurality of projections, or spacer elements, which create multiple paths of air flow between a face of the single sheet web and the underlying roof. Two narrow elongate strips of air permeable media are adhesively secured to the web lengthwise between adjacent rows of projections to prevent weather and insect infiltration into the attic space.

Other rollable ventilation products are known. U.S. Pat. No. 5,651,734 issued to Morris discloses a roll-form roof ridge ventilator made of a longitudinal blank of scored corrugated plastic sheet material. The vent is installed by unrolling the sheet material on a roof, folding the vent upon itself at scored lines, and securing the folded sections of the vent to the roof ridge.

U.S. Pat. No. 4,942,699, which issued to Spinelli and which is owned by the assignee of the present application, and the embodiment illustrated in FIG. 5 of U.S. Pat. No. 5,425,672, which issued to Rotter, disclose indeterminate-length, roll-form ventilation products made of matting material which are installed overlying roof ridges and which support a row of overlying cap shingles.

The embodiment illustrated in FIG. 12 of U.S. Pat. No. 3,660,955 issued to Simon discloses an indeterminate-length, roll-form web of plastic sheet material which has a plurality of spacer elements and which is unrolled and installed between rows of overlapping shingles to provide air passageways therebetween.

Roll-form roof ridge vents provide many advantages relative to non-roll-form, sectional roof ridge vent products. Roll-form vents are less costly to manufacture, facilitate efficient storage and transportation, and involve less labor costs to install. The roll form vents are installed as a continuous vent structure along the entire length of the roof ridge; while, sectional vents may require four or more separate sections to be installed in an end-to-end overlapping relation. Examples of sectional roof ridge vents are provided by U.S. Pat. Nos.: 1,717,728 issued to Moore; U.S. Pat. No. 2,200,031 issued to Lee; U.S. Pat. No. 2,214,183 issued to Seymour; U.S. Pat. No. 2,704,500 issued to Bonforte; U.S. Pat. No. 2,868,104 issued to Honholt et al.; U.S. Pat. No. 2,799,214 issued to Roose; U.S. Pat. No. 3,185,070 issued to Smith; U.S. Pat. No. 3,236,170 issued to Meyer et al.; U.S. Pat. No. 3,311,047 issued to Smith et al.; U.S. Pat. No. 3,481,263 issued to Belden; U.S. Pat. No. 3,949,657 issued to Sells; U.S. Pat. No. 4,280,399 issued to Cunning; U.S. Pat. Nos. 4,325,290, 4,554,862 and U.S. Pat. No. 5,122,095 issued to Wolfert; U.S. Pat. No. 4,876,950 issued to Rudeen; U.S. Pat. No. 4,903,445 issued to Mankowski; U.S. Pat. No. 4,957,037 issued to Tubbesing et al.; U.S. Pat. No. 4,962,692 issued to Shuert; U.S. Pat. No. 5,094,041 issued to Kasner et al.; U.S. Pat. No. 5,167,579 issued to Rotter; U.S. Pat. No. 5,174,076 issued to Schiedegger et al.; and U.S. Pat. No. 5,288,269 issued to Hansen.

In some situations, known roll-form roof ridge vents, specifically those made of rigid plastic material, can be difficult to center and align over a relatively long roof ridge. This is because roll-form vents, when unrolled, extend in a substantially straight line, and during installation, do not permit ready realignment or adjustment from the straight path taken during unrolling. Therefore, if the roof ridge unwantedly deviates from a straight path, or if the roll-form vent is not precisely angularly aligned during initial installation, the center of the vent may unwantedly shift away from the roof ridge at certain locations. Attempts by an installer to laterally and/or angularly realign the roll-form vent relative to the roof ridge may result in unaesthetic buckling or distorting of the vent along its length.

Therefore, while the roll-form and sectional roof ridge vents disclosed in the above referenced patents may function satisfactorily under certain circumstances, there is a need for a roof ridge vent which provides all the above stated advantages of a roll-form vent while being capable of being properly and readily aligned along its length on a roof ridge. The vent should be capable of being centered over a roof ridge which does not form a perfectly straight path and should accommodate lateral and/or angular adjustments required when initial installation begins at an unwanted offset angle relative to the roof ridge line. In addition, the vent should be capable of being manufactured efficiently by thermoforming molding equipment, preferably continuous vacuum rotary thermoforming equipment, and formed into a roll for shipping, transportation and subsequent installation.

OBJECTS OF THE INVENTION

With the foregoing in mind, a primary object of the present invention is to provide an efficient and economical roof vent which is capable of being readily and properly installed in a manner requiring labor skills possessed by the average roof installer.

Another object of the present invention is to provide a roof ridge vent having means for permitting ready lateral and/or angular alignment of the vent along its length relative to the roof ridge to enable the vent to be centered over the roof ridge without the vent's becoming buckled and/or distorted.

A further object of the present invention is to provide a roof ridge vent which has a low height profile which permits use of standard pneumatic roofing nail guns to properly secure the vent to the roof and which provides an accepted amount of air venting capacity.

A still further object of the present invention is to provide a roof ridge vent which is made as a continuous, indeterminate-length web which can be stored, transported and supplied to installers in roll-form.

A still further object of the present invention is to provide a roll-form roof ridge vent which is efficiently manufactured using continuous vacuum rotary thermoforming techniques and which is efficiently bonded to a strip of air permeable filter material to prevent infiltration of weather and insects through the vent.

SUMMARY OF THE INVENTION

More specifically, the present invention provides a roof ridge vent for installation overlying an open roof ridge to provide ventilation to a space beneath a roof. The vent is constructed as a continuous, indeterminate-length, single-sheet, roll-form web of plastic material which is rolled lengthwise into a spiral roll during manufacture and unrolled lengthwise in a substantially straight direction during installation on the roof ridge. Thus, when installed, the web forms a continuous, one-piece roof ridge vent along the entire roof ridge.

The vent includes alignment means which is integrally formed in the web and which enables the web to be laterally and/or angularly repositioned along its otherwise substantially straight length so that, during installation, the vent can be properly aligned over the roof ridge in a non-distorted and unbuckled manner.

According to one embodiment of the present invention, the alignment means is provided by a plurality of expandable live hinges formed transversely at spaced locations along the length of the web. The expandable live hinges permit lateral angular deflections of the web along its relatively straight length during installation to ensure that the web is centered along its entire length over the roof ridge.

According to another embodiment of the present invention, the alignment means is provided by a lengthwise-extending central hinge portion of the web. The hinge portion is made of a pliable material which permits the roof ridge vent to be laterally deflected and centered over said open roof ridge.

BRIEF DESCRIPTION OF THE DRAWINGS

The foregoing and other objects, features and advantages of the present invention should become apparent from the following description when taken in conjunction with the accompanying drawings, in which:

FIG. 2 is a perspective view of a spiral roll of the first embodiment of the rolled roof vent;

FIG. 6 is a perspective view of a length of a third embodiment of a rolled roof vent;

FIG. 7 is a cross-sectional view of the vent of FIG. 6 taken along line 7—7;

FIG. 8 is a perspective view of a length of a fourth embodiment of the rolled roof vent; and FIG. 9 is a cross-sectional view of the vent of FIG. 8 taken along line 9—9.

DETAILED DESCRIPTION OF THE PREFERRED EMBODIMENT

Figures 1, 1A:
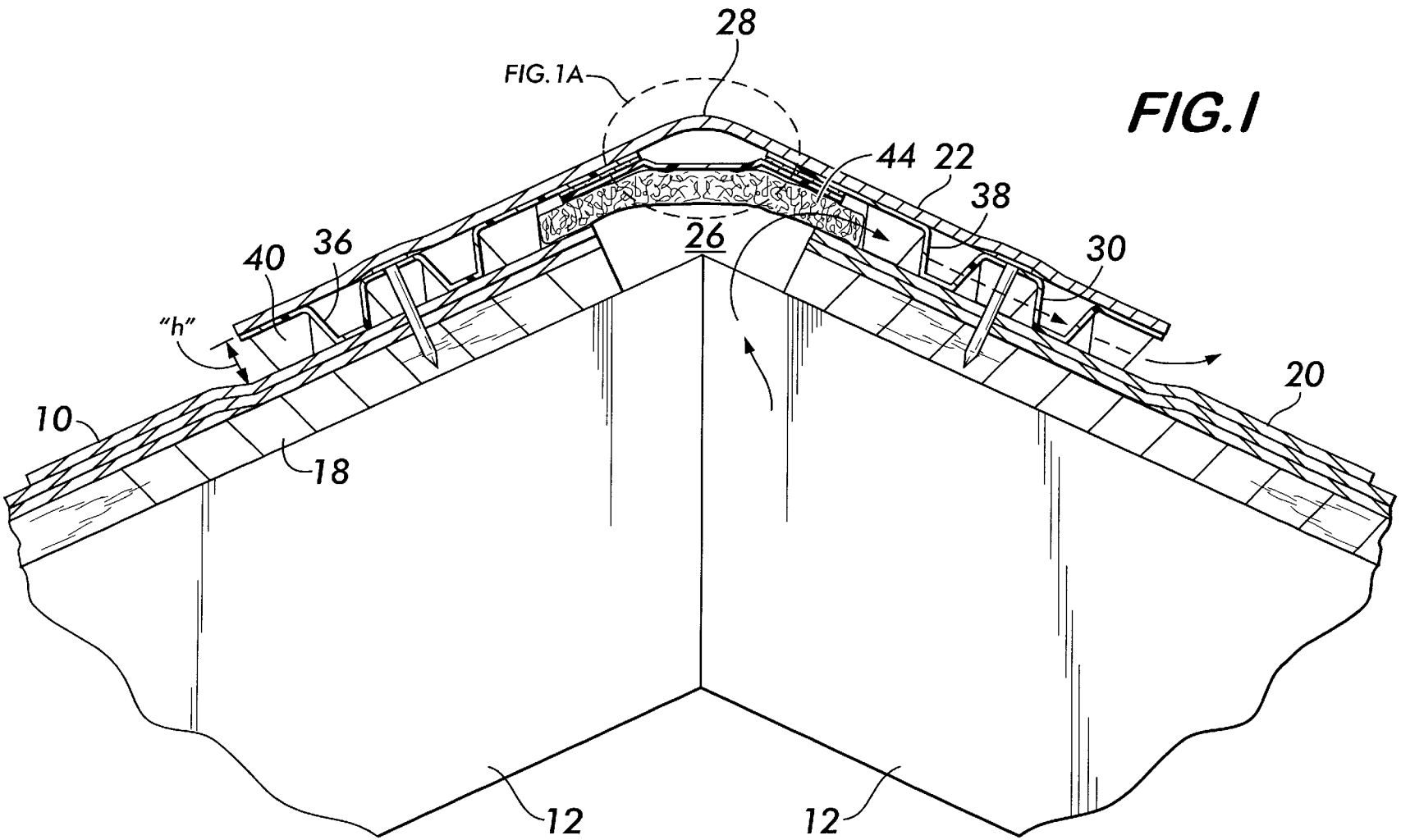
FIG. 1 is a cross-sectional view transverse to a roof ridge line illustrating a rolled ridge vent embodying the present invention.
FIG. 1A is a greatly magnified cross-sectional view of a longitudinal medial hinge strip of a first embodiment according to the present invention.

Referring now to the drawings, FIG. 1 illustrates a roof 10 having a typical construction which utilizes a roof ridge vent 30. The roof 10 is constructed from a plurality of rafters 12 supported at their lower ends by front and rear walls (not shown) of the building. A roof deck 18 is typically constructed of plywood, or other suitable panels, to provide an outer sheathing of the building. The roof deck 18 is secured to the rafters 12 and extends to the end walls.

Shingles 20 are secured to the roof deck 18, typically with nails, to finish sloping portions of the roof 10 in accordance with conventional construction practices. Conventional cap shingles 22 are installed in overlapping fashion to cover the roof ridge, or peak, 28. A slot 26 is provided along the length of the roof ridge 28 of the exemplified roof 10 to provide a passageway for venting air between the underlying attic area and the ambient atmosphere.

In accordance with the present invention, as will be fully discussed, a vent 30 is interposed between the cap shingles 22 and the underlying portions of the roof 10. The vent 30 is a roll-form type product which is rolled lengthwise into a spiral roll during manufacture and which is stored, transported and supplied to installers in roll-form. See FIG. 2. As with other known roll-form ventilation products, the vent 30 is unrolled lengthwise on the roof 10; positioned overlying the roof ridge 28; and secured to the roof 10 with nails or the like. Thus, the vent 30 provides a continuous, one-piece ventilation product which extends in a substantially straight direction and which is relatively simple to install.

The vent 30 of the present application has some similarities with the previously referenced roll-form vent disclosed in U.S. Pat. No. 5,673,521. For instance, the vent 30 is formed as an indeterminate-length, single-sheet web 32 of thermoformable plastic material having a longitudinal medial hinge, or centerline, 34 dividing the web 32 into a pair of identical longitudinally-extending lateral portions, or side flaps, 36 and 38, which, during installation, are capable of being disposed at a dihedral angle relative to one another.

Each web portion 36 and 38 has a plurality of hollow spacer elements 40 disposed in a plurality of longitudinal rows extending along the lengthwise edge margins of the web portions 36 and 38. The spacer elements 40 project from a face 42 of the web 32 and, when the vent 30 is installed, space the face 42 of the web 32 from the roof 10 to provide ventilation passageways therebetween. The layout, or pattern, of the spacer elements 40 is particularly designed to resist compression of the vent 30 during and after installation and to afford ready rolling and unrolling during manufacture and installation.

At least one continuous length of filter media is secured to the face 42 of the web 32. For example, as illustrated in FIGS. 1 and 2, one continuous length of filter media 44 is thermally or adhesively bonded along a center longitudinal location of the web 32 such that the filter media 44 extends on the web between the spacer elements 40 on lateral web portion 36 and the spacer elements 40 on lateral web portion 38. Alternatively, a first filter media could be attached on web portion 36 and a second filter media could be attached on web portion 38 as disclosed in U.S. Pat. No. 5,673,521 which is incorporated herein by reference. The filter media permits air to flow outwardly in the manner illustrated by the arrows in FIG. 1, while preventing insects, rain, snow, blowing foreign objects, and the like from entering in the opposite direction. Preferably, the filter media is of high loft non-woven material. Alternatively, the filter media could be formed of needle-punched non-woven material, metal mesh screens, or like structures which provide air permeability through small spaces in their structure.

A novel aspect of the present invention is provided by the integral formation of alignment means 46 on the vent to enable the vent to be laterally and/or angularly deflected from the vent's otherwise substantially straight longitudinal configuration. The alignment means 46 is utilized by an installer to readily adjust the positioning of the vent on the roof ridge 28 as the vent is being installed. For example, if the roof ridge is not perfectly straight, the alignment means 46 enables the otherwise straight vent to be laterally deflected, without appearing distorted or buckled, and secured over the center of the roof ridge. As another example, if during installation the vent becomes offset from the roof ridge due to a slight initial alignment error at one end, the offset error is readily correctable at a downstream location of the vent by laterally realigning the downstream portion of the vent over the center of the roof ridge before securing it to the roof.

As best illustrated in FIGS. 1A and 2, a first embodiment of an integrally formed alignment means 46 is provided by using a strip 48 of relatively pliable material to form the longitudinal medial hinge 34. Thus, when the web 32 is deflected laterally, such as by the installer's pulling an unsecured length of the vent 30 in a lateral direction relative to a secured portion, the pliable strip 48 permits the web 32 to be laterally realigned with the roof ridge without buckling or distortion. Since the pliable medial strip 48 is continuous, the vent 30 is capable of being laterally deflected at any location along the length of the web 32.

The pliable strip 48 is formed integrally with the pair of longitudinally-extending lateral portions 36 and 38 of the web 32. To this end, during manufacture, the web 32 is made of two different types of thermoformable material which are coextruded to form a single, integral thermoformable sheet. The medial strip material has a different durometer and thickness than the durometer and thickness of the longitudinally-extending lateral portions 36 and 38. See FIG. 1A which is greatly enlarged, or magnified, in order to best illustrate the difference between the thickness of the strip 48 and the thickness of the lateral portions, 36 and 38. An example of materials used to make the dual durometer vent 30 is Santoprene, which is pliable, for the medial hinge strip 48, and HDPE, which is relatively rigid, for the lateral portions 36 and 38.

As best illustrated in FIGS. 3–9, second, third and fourth embodiments of vents, 50, 60 and 70, have integrally formed alignment means 46 which are provided by sets of expandable live hinges, 52, 62 and 72, disposed transversely at spaced locations on the vent. The expandable live hinges 52, 62 and 72 enable the vent to be angularly directed at discrete locations. Preferably, the expandable live hinges 52, 62 and 72 extend perpendicular to the longitudinal centerlines 54, 64 and 74 and are located at equally spaced intervals "d" on the vents, such as, every two feet. In these embodiments, the webs of thermoplastic material are made of a single type of plastic material, such as HDPE.

Figure 3:
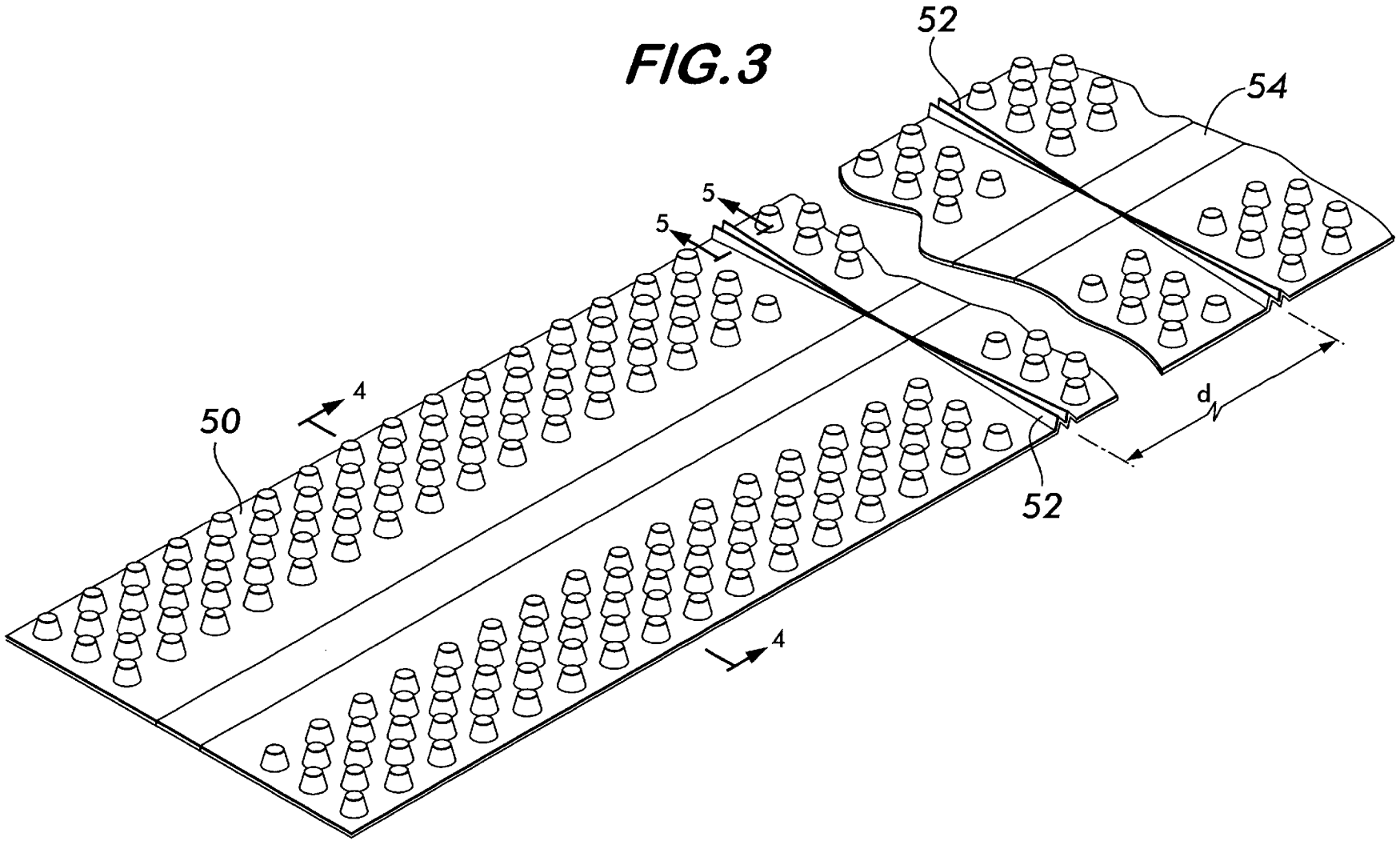
FIG. 3 is a perspective view of a length of a second embodiment of the rolled roof vent according to the present invention.
Figure 4:
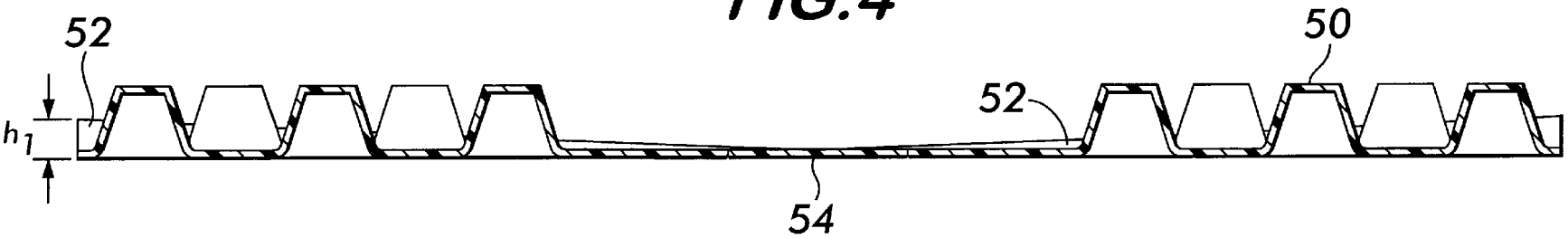
FIG. 4 is a cross-sectional view of the vent of FIG. 3 taken along line 4—4.
Figure 5:
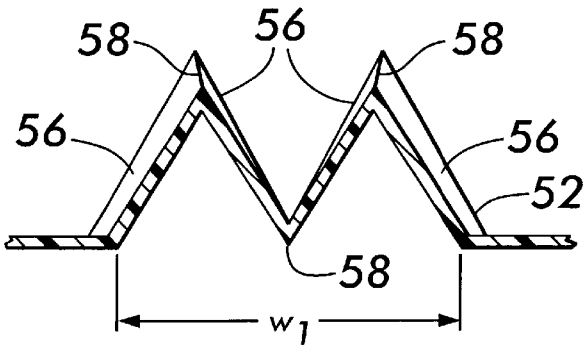
FIG. 5 is a cross-sectional view of the vent of FIG. 3 taken along line 5—5.

As illustrated in FIGS. 3–5, each expandable live hinge 52 is formed by a plurality of opposed wall sections 56 which taper downwardly relative to the face of the web to a plurality of creases 58. Each expandable live hinge 52 has a W-shaped vertical cross-section as illustrated in FIG. 5, and increases in height "$h_1$" and width "$w_1$" as the hinge 52 extends laterally in an outward direction from the centerline 54 of the vent 50 as illustrated in FIGS. 3 and 4. The creases 58 enable the wall sections 56 to foldably open and close in an accordion-type, or bi-fold type, manner. Thus, if the wall sections 56 on one side of the vent centerline 54 are expanded, and the wall sections 56 on the opposite side of the centerline 54 are collapsed, the vent 50 will be angularly directed toward the collapsed side of the expandable live hinge 52. Typical angular adjustments on the order of between about 5° to about 30° are provided at each such hinge.

Alternate configurations of expandable live hinges are illustrated in FIGS. 6–9. The embodiment in FIGS. 6 and 7 illustrate an expandable live hinge 62 having a substantially U-shaped vertical cross-section including four planar wall portions 66 and three creases 68. The height "$h_2$" and width "$w_2$" of the expandable live hinge 62 is tapered such that the size of the hinge 62 increases as it extends laterally outward from each side of the vent centerline 64. The embodiment of FIGS. 8 and 9 illustrate an expandable live hinge 72 having a W-shaped vertical cross section which has a substantially constant height "$h_3$" and width "$w_3$". Thus, in this embodiment, the expandable live hinge 72 extends across the centerline 74 of the vent 70 instead of tapering into and merging with the centerline as disclosed in previously described vents 50 and 60.

Installation of any of the above described embodiments of the present invention is straightforward. After delivery to the construction site, the vent, 30, 50, 60 or 70, is unrolled on the roof 10 and disposed with its spacer elements 40 facing downward. The vent is positioned over the roof ridge 28, and nailing of the vent to the roof is initiated at one end of the roof ridge. As the vent is nailed, the longitudinally-extending lateral portions 36 and 38 are fixed in an angulated position as illustrated in FIG. 1. As the nailing operation continues and advances forward from the end of the roof ridge, if the vent should begin to become offset from the center of the roof ridge, the alignment means 46 of the vent enables the installer to properly re-align the offset vent over the center of the roof ridge. The realigned vent is nailed in place and further nailing continues until further realignment is required, or until the opposite end of the roof ridge is reached. After having been mounted in place, the vent is cut to the required length and endcaps (not shown) are used to seal the gable ends of the vent.

Preferably, the endcaps utilized with the vents 30, 50, 60 and 70 of the present invention are made of closed-cell polyethylene foam and are relatively inexpensive to manufacture and simple to install. To this end, the endcaps are diecut from a master foam sheet to form a finished profile which is capable of being inserted underneath the end of the mounted vent. The endcaps have pre-punched nail holes and a line printed on its centerline so that the endeaps are readily positioned into the end of the mounted vent. Nails are driven through the vent and nail holes of the endcap to secure closed the end of the vent.

Another important aspect of the vent according to the present invention is that it is provided with a sufficiently low profile, or height, so that commercially available standard-size pneumatic roofing nail guns can be utilized to nail the vent to the roof. Standard nail guns are limited to use with nails no greater than about 1.75 inches, and the nails must extend a sufficient distance into the roof decking for the nails to meet roofing installation requirements. Thus, if the vent has too great a thickness, or height, nail guns cannot be used because the nails do not embed far enough into the roof decking. To enable the use of standard nail guns to install the vents 30, 50, 60 and 70 of the present invention, the vents are provided with a maximum height "h" of about 0.6875 inches. Tests have shown that standard nail guns can be utilized to properly install a vent having the above referenced maximum height. A vent made with the stated maximum height, provides ten to twelve square inches of net free ventilation area per linear foot of product which is within industry ventilation standards.

By way of example, and not by way of limitation, the vents 30, 50, 60 and 70 are provided with a width of about 11 inches and a thickness of about 0.6875 inches. The initial thickness of the sheet material used to fabricate the vent structures are preferably in a range of about 0.020 inch to about 0.040 inch. The pliable center strip 48, if provided, has a width of about 1 inch and a thickness of about 0.030 inch. The expandable live hinges, 52, 62 or 72, if provided, have a maximum width of about 0.2 inches, a maximum height of about 0.5 inches, and are spaced at approximately two foot intervals. The spacer elements 40 are provided in two, three, four or five offset longitudinal rows on each lateral portion 36 and 38 of the web, and the web 32 includes about fifty spacer elements per linear foot of vent. Each spacer element 40 has a diameter of about 0.5 inches, a height of about 0.625 inches, and is spaced about an inch from the adjacent spacer elements. The vents 30, 50, 60 and 70 are preferably provided with nail line indicators and the vents 50, 60 and 70 are preferably provided with a pair of molded center score lines 76.

In the presently preferred forms of the invention, the vents are mostly composed of HDPE, but could also be made from high impact styrene, ABS, PP, PVC or a blend of any of these suitable polymers which are capable of being thermoformed. Other suitable materials could be utilized, such as nylon or polyester. The pliable medial strip 48 is preferably made of Santoprene, but could be made of other materials, such as, PVC, EPDM rubber and ABS.

Preferably, the vents 30, 50, 60 and 70 are manufactured efficiently in a continuous rotary thermoforming process. Examples of rotary thermoforming processes are provided by U.S. Pat. Nos. 3,027,596 issued to Knowles; U.S. Pat. No. 4,244,915 issued to Boardman; and U.S. Pat. Nos. 4,252,590 and 4,212,692 issued to Rasen et al. The Knowles patent discloses extruding a substantially planar sheet of thermoformable material onto a continuously rotating drum which vacuum forms cup-shaped articles into the continuously moving sheet of thermoformable material. Other operations such as thermal treating, severing or trimming the sheet are disclosed.

The vents of the present invention are made in a similar process. The thermoformable material is extruded as a planar sheet onto a rotating drum. If the vent is to be made with a pliable medial hinge strip 48, dual durometer materials are coextruded to form an integral sheet. The drum rotates continuously and vacuum forms the spacer elements 40 and expandable live hinges, 52, 62 or 72, if provided. The continuous filter media 44 is properly positioned and rolled into contact with the relatively hot moving web to become secured thereto via thermal bonding techniques. Alternatively, the filter media is adhesively bonded to the web, or is frictionally captured to the web via adjacent spacer elements. The thermoformed sheet is subsequently cooled, trimmed, rolled and packaged to form products which are ready for storage, transportation or sale. The use of a continuous vacuum rotary thermoforming process results in increased rates of throughput, decreased amounts of unused scrap material since the trimmed scrap is promptly directed back to the extruding equipment, and decreased costs of manufacture.

Thus, the above-described roof ridge vents according to the present invention provide a readily adjustable roll-form vent product which is easy to install. The integral alignment means permit the vents to be aligned and realigned during installation to ensure that the vent is properly centered. The vent permits installation with standard nail guns in an economical manner.

While preferred ridge roof vents have been described in detail, various modifications, alterations, and changes may be made without departing from the spirit and scope of the vent according to the present invention as defined in the appended claims.

What is claimed is:

1. A roof ridge vent for installation overlying an open roof ridge to provide ventilation to a space beneath a roof, comprising:

a continuous, indeterminate-length, single-sheet, roll-form web of plastic material, said web capable of being rolled lengthwise into a spiral roll during manufacture and unrolled lengthwise in a substantially straight direction during installation on the roof ridge to form a continuous, one-piece roof ridge vent along the roof ridge; and alignment means integrally formed on said web so that said web is capable of being laterally repositioned along its length from said substantially straight lengthwise direction of said web;

said alignment means including a plurality of expandable live hinges formed transversely at spaced locations on said web, said expandable live hinges permitting lateral angular deflections of said web along its relatively straight length during installation to ensure that said web is centered along its length over the roof ridge;

whereby during installation said web can be aligned with the roof ridge.

2. A roof ridge vent for installation overlying an open roof ridge to provide ventilation to a space beneath a roof, comprising:

a continuous, indeterminate-length, single-sheet, roll-form web of plastic material, said web capable of being rolled lengthwise into a spiral roll during manufacture and unrolled lengthwise in a substantially straight direction during installation on the roof ridge to form a continuous, one-piece roof ridge vent along the roof ridge; and alignment means integrally formed on said web so that said web is capable of being laterally repositioned along its length from said substantially straight lengthwise direction of said web;

said alignment means being provided by a lengthwise central hinge strip, said hinge strip being made of an elastomeric material which permits the roof ridge vent to be laterally deflected and centered over said open roof ridge;

whereby during installation said web can be aligned with the roof ridge.

3. A roof ridge vent according to claim 2, wherein said central hinge strip has opposite longitudinally-extending edges; wherein said web includes a pair of rigid longitudinally-extending outer flaps, one of said outer flaps extending from one of said edges of said central hinge strip and the other of said outer flaps extending from the opposite edge of said central hinge strip; and wherein said rigid outer flaps are made of a plastic material of a predetermined durometer and said hinge strip is made of an elastomeric material of a predetermined durometer different than said outer flap durometer.

4. A roof ridge vent according to claim 3, wherein said outer flaps are coextruded integrally with said central hinge strip.

5. A roof ridge vent according to claim 4, wherein said outer flaps are made of HDPE and said central hinge strip is made of Santoprene.

6. A roof ridge vent according to claim 1, wherein said expandable live hinges are molded integrally on said web at equally spaced apart intervals; wherein said web has a lengthwise centerline; and wherein each of said expandable live hinges extends substantially perpendicular to said lengthwise centerline.

7. A roof ridge vent according to claim 6, wherein each of said expandable live hinges includes at least a pair of opposed wall sections tapering downwardly from a face of said web to at least one crease portion, said wall sections being capable of foldably opening and closing in an accordion-type manner.

8. A roof ridge vent according to claim 7, wherein, on opposite sides of said centerline, said expandable live hinges have a height and width which increase as they extend laterally outward from said centerline.

9. A roof ridge vent according to claim 7, wherein each of said expandable live hinges includes four tapered wall sections and three creases forming a w-shaped configuration in transverse, vertical cross-section.

10. A roof ridge vent according to claim 1, further comprising a plurality of hollow spacer elements formed integrally on, and projecting in a spaced relation from, a face of said web to space said single-sheet web from the roof and create a path of ventilation between the roof and said web face when said web is installed on the roof ridge.

11. A roof ridge vent according to claim 10, wherein said spacer elements are thermoformed integrally on said web and have a height of no greater than about 0.6875 inch.

12. A roof ridge vent according to claim 10, further comprising at least one length of air permeable filter media which is secured on said web face and which resists weather and insect infiltration into said path of ventilation.

13. A roof ridge vent according to claim 12, wherein said air permeable filter media is a highloft fabric.

14. A roof ridge vent according to claim 10, wherein said web, including said spacer elements and said alignment means, is formed by a continuous vacuum rotary thermoforming technique.

15. A roof ridge vent for installation on a roof overlying an open roof ridge, comprising:

a continuous, indeterminate-length, single-sheet, roll-form web of thermoformable material, said web capable of being rolled lengthwise into a spiral roll during manufacture and unrolled lengthwise in a substantially straight direction during installation on the roof ridge;

a plurality of hollow spacer elements thermoformed integrally on, and projecting in a spaced relation from, a face of said web for spacing said face of said single-sheet web from the roof thereby creating a path for ventilation between the roof and said web face when said web is installed on the roof ridge;

at least one continuous length of air permeable filter media attached to said web face for preventing weather and insect infiltration into said ventilation path; and means integrally formed on said web for permitting said web, along said web length, to be laterally repositioned relative to said substantially straight lengthwise direction so that said web can be realigned with and centered over, the roof ridge during installation;

said means including a plurality of expandable live hinges formed transversely and integrally at spaced locations on said web, said expandable live hinges permitting lateral deflections of said web along its relatively straight length during installation to ensure that said web is centered throughout its length over the roof ridge.

16. A roof ridge vent for installation on a roof overlying an open roof ridge, comprising:

a continuous, indeterminate-length, single-sheet, roll-form web of thermoformable material, said web capable of being rolled lengthwise into a spiral roll during manufacture and unrolled lengthwise in a substantially straight direction during installation on the roof ridge;

a plurality of hollow spacer elements thermoformed integrally on, and projecting in a spaced relation from, a face of said web for spacing said face of said single-sheet web from the roof thereby creating a path for ventilation between the roof and said web face when said web is installed on the roof ridge;

at least one continuous length of air permeable filter media attached to said web face for preventing weather and insect infiltration into said ventilation path; and means integrally formed on said web for permitting said web, along said web length, to be laterally repositioned relative to said substantially straight lengthwise direction so that said web can be realigned with and centered over, the roof ridge during installation;

said web including a pair of rigid lengthwise-extending outer flaps, and said means being provided by a lengthwise central hinge strip which is coextruded with, and integrally formed between, said outer flaps, and wherein said central hinge strip is made of an elastomeric material so that said central hinge strip is capable of effecting realignment of said web over the roof ridge.

17. A roof ridge vent according to claim 15, wherein said web has a lengthwise centerline; and wherein each of said expandable live hinges is thermoformed integrally into said web, extends across and substantially perpendicular to the lengthwise centerline of said web, and includes at least a pair of opposed wall sections tapering downwardly from a face of said web to at least one crease portion, said wall sections being capable of foldably opening and closing in an accordion-type manner to permit the relatively straight length of said web to be angularly redirected into alignment with the roof ridge during installation.

18. A roof ridge vent according to claim 15, wherein said web is formed by a continuous vacuum rotary thermoforming technique, and wherein said spacer elements have a height of no greater than about 0.6875 inch.

19. A roof ridge vent according to claim 2, wherein said central hinge strip is a thin, flat, flexible strip of elastomeric material having a width of at least about one inch and a thickness of at least about 0.03 inch.

20. A roof ridge vent according to claim 16, wherein said central hinge strip is a thin, flat, flexible strip of elastomeric material having a width of at least about one inch and a thickness of at least about 0.03 inch.

* * * * *